US005373670A

United States Patent [19]

Sasaki et al.

[11] Patent Number: 5,373,670

[45] Date of Patent: Dec. 20, 1994

[54] SHAKEPROOF BEARING

[75] Inventors: Teruo Sasaki; Kazuhiro Fujisawa; Yoshiaki Miyamoto, all of Hyogo; Mitsuo Miyazaki, Saitama; Fumiaki Arima, Kanagawa; Yuji Mitsusaka, Saitama, all of Japan

[73] Assignee: Sumitomo Gomu Kogyo Kabushiki Kaisha,, Kobe, Japan

[21] Appl. No.: 79,856

[22] Filed: Jun. 22, 1993

Related U.S. Application Data

[63] Continuation of Ser. No. 347,643, May 5, 1989, abandoned.

[30] Foreign Application Priority Data

May 6, 1988 [JP] Japan ..... 63-110720

[51] Int. Cl.[5] ..... E04B 1/98

[52] U.S. Cl. ..... 52/167 E; 52/167 DF; 267/141.1

[58] Field of Search ..... 52/167, 393, 373, 167 DF; 267/140.4, 141.1, 141.6

[56] References Cited

U.S. PATENT DOCUMENTS

| | | | |
|---|---|---|---|
| 1,936,389 | 11/1933 | Hallqvist | 267/140.4 |
| 3,218,008 | 11/1965 | Harris | 52/167 X |
| 4,121,393 | 10/1978 | Renault et al. | 52/167 |
| 4,660,811 | 4/1987 | Mühlhahn et al. | 267/141.1 |
| 4,713,917 | 12/1987 | Buckle et al. | 52/167 |
| 4,761,925 | 8/1988 | Fukahavi et al. | 52/167 |
| 4,765,600 | 8/1988 | Härtel | 267/141.1 |
| 4,924,640 | 5/1990 | Suizu et al. | 52/167 DF |

FOREIGN PATENT DOCUMENTS

| | | | |
|---|---|---|---|
| 2334332 | 1/1975 | France | 52/167 |
| 1271346 | 6/1968 | Germany | 52/167 |
| 134230 | 8/1984 | Japan | 52/167 |
| 215824 | 9/1986 | Japan | 267/141.1 |
| 141330 | 6/1987 | Japan | 52/167 |
| 687467 | of 1953 | United Kingdom | 267/140.4 |
| 1204841 | 1/1986 | U.S.S.R. | 267/141.1 |

*Primary Examiner*—Carl D. Friedman
*Assistant Examiner*—Beth A. Aubrey
*Attorney, Agent, or Firm*—Nikaido, Marmelstein, Murray & Oram

[57] ABSTRACT

A shakeproof bearing or an earthquake-proofing structure (10) comprises a columnar bearing body (13) and a surrounding high damping elastomer (14). The bearing body (13) includes a stack of rigid plates (12) and elastic plates (11) alternating with one another. The high damping elastomer (14) may be shaped into an annular cylinder or, alternatively, may be in the form of a columnar stack of alternating annular rigid plates (18) and annular high-damping-elastomer plates (17).

6 Claims, 3 Drawing Sheets

SHAKEPROOF BEARING

This application is a continuation of application Ser. No. 07/347,643 filed May 5, 1989 now abandoned.

BACKGROUND OF THE INVENTION

Field of Invention

The present invention relates to a shakeproof bearing using a high damping elastomer made of butyl rubber, NBR or the like as an energy absorber (hereinafter called a damper).

SUMMARY OF THE INVENTION

The following structure has been hitherto known as a shakeproof bearing for protecting a superstructure such as a building from destructive force of earthquake by slidably supporting this superstructure on a substructure such as its foundation in the horizontal direction, and reducing the input acceleration of the earthquake.

What is shown in FIG. 9 is a shakeproof bearing alternately laminating a hard plate 1 such as steel plate, and a rubber-like elastic plate 2 low in compression set. This shakeproof bearing 3 has an extremely large ratio of the modulus of elasticity in the vertical direction to the modulus of elasticity in the horizontal direction, and it can support the building slidably in the horizontal direction while keeping stable in the perpendicular direction. Moreover, the natural oscillation period of the building is made longer than the period of the maximum amplitude component of the earthquake, so that the acceleration response of the building when struck by an earthquake can be reduced. This shakeproof bearing itself has hardly any capacity for absorbing vibration energy during aseismic action, it is necessary to be furnished with a damper for absorbing energy.

However, because of this damper, the space of the entire device becomes large, and the number of points of action of force increases, and the design becomes complicated, or the installation cost becomes high. Besides, in the plastic dampers such as steel bar dampers mainly used hitherto, deterioration by use was quick, and it was necessary to replace after a certain period of use.

Accordingly, as a one-piece structure containing the damper, the shakeproof bearings as shown in FIG. 10 to FIG. 12 were devised.

FIG. 10 shows a shakeproof bearing having a lead plug 4 placed in the middle of the shakeproof bearing 3 shown in FIG. 9 as a damper to absorb energy (Japanese Patent Publication 61-17984).

However, because of this lead plug 4, after deformation, the superstruture is hard to return to the original position, and the initial stiffness is too high so that the small vibrations are directly transmitted to the superstructure, thereby leading to new problems.

What is shown in FIG. 11 is a shakeproof bearing intended to eliminate the defects of the lead plug 4 by using a high damping elastomer 5 possessing an action for absorbing vibration energy for the rubber-like elastic plates in the shakeproof bearing 3 explained in FIG. 9 (Japanese Laid-Open Patent 62-83139).

In this shakeproof bearing 6, however, since the high damping elastomer 5 directly supports the large vertical load of the superstructure, the creep amount is large, and the internal strain increases, and the durability (life) is poor.

The shakeproof bearing 8 shown in FIG. 12 is designed so that the high damping elastomer may not directly support the large vertical load of the superstructure. In this structure, a penetration hole is opened in the vertical direction in the middle of the shakeproof bearing 3 in FIG. 9, and a high damping elastomer 7 is inserted in this penetration hole so as to absorb the vibration energy (Japanese Laid-Open Utility Model 61-39705).

The shakeproof bearing 8 shown in FIG. 12 appears to support the vertical load only by the laminated portion of hard plate 1 such as steel plate and rubber-like elastic plate 2. Actually, however, the high damping elastomer 7 also supports the vertical load substantially. This is explained below. When loaded in the vertical direction, the rubber-like elastic plate 2 is compressed, and, same as a strain occurs, the internal high damping elastomer 7 is compressed and bulges out in the horizontal direction. Its circumference is confined by the hard plate 1 and rubber-like elastic plate 2. As a result, the high damping elastomer 7, same as the rubber-like elastic plate 2, supports the vertical load. Therefore, when an elastomer having a large creep amount is used inside, the creep strain of the entire bearing increases. The high damping elastomer generates, by nature, a large creep strain. Accordingly, although the creep amount of the shakeproof bearing 8 shown in FIG. 12 is small as compared with that of the shakeproof bearing 6 shown in FIG. 11, it is larger as compared with that of the shakeproof bearing 3 made of an elastomer small in damping as shown in FIG. 9. Hence, the durability is impaired by the internal strain due to creep.

It is hence a primary object of the invention to present a shakeproof bearing small in vertical creep deformation in a shakeproof bearing using a high damping elastomer as a damper.

To achieve the above object, this invention presents a shakeproof bearing characterized by disposing a high damping elastomer on the circumference of a bearing body the high damping elastomer being formed by alternately laminating a hard plate possessing stiffness and a rubber-like elastic plate low in compression set.

The high damping elastomer may be also presented as a laminate formed by alternately laminating and adhering a hard plate possessing stiffness and a plate-shaped high damping elastomer.

The high damping elastomer in the shakeproof bearing of the invention is disposed on the outer circumference of the bearing body subjected to vertical load, and is free to bulge out to the deformation stress due to external force when struck by an earthquake. Accordingly, it is free from vertical load, and creep is not generated, and hence the life is long.

When the high damping elastomer is formed as a laminate containing a hard plate therein, the movement of the high damping elastomer in the vertical direction is defined, and the amount of strain per unit volume to the vibration in the horizontal direction increases. Accordingly, as compared with the structure without lamination, the damping constant can be increased.

DETAILED DESCRIPTION OF THE INVENTION

Figure 1:
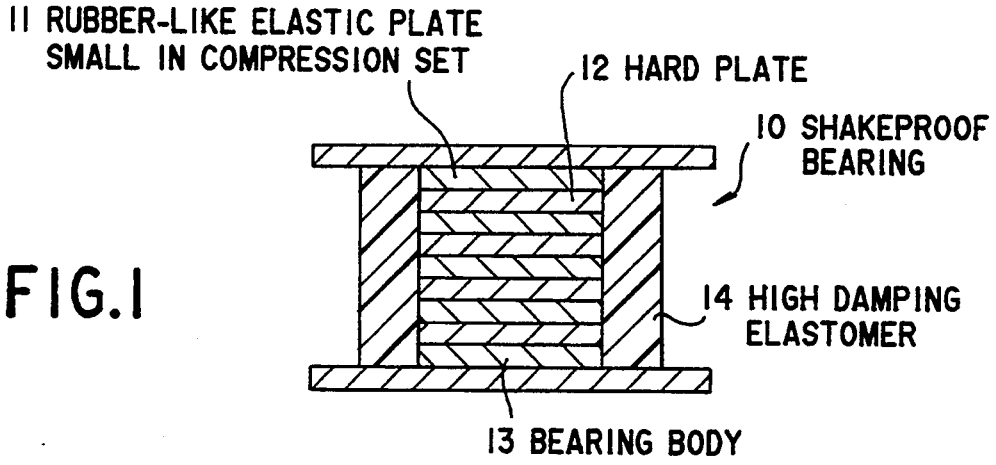
FIG. 1 is a sectional view showing an embodiment of a shakeproof bearing of the invention.

A basic structure of the shakeproof bearing 10 of the invention is shown in FIG. 1. This shakeproof bearing 10 is composed by forming a columnar bearing body 13 by alternately laminating a rubber-like elastic plate 11 low in compression set, such as natural rubber, and a hard plate 12, such as steel plate, with its circumference surrounded by a high damping elastomer 14. Between this high damping elastomer 14 and the bearing body 13, although it is not necessary to provide a gap, it is better not to adhere with each other. If the damping capacity of the rubber-like elastic plate 11 low in compression set is high or low, it may be adjusted by varying the quantity or performance of the externally mounted high damping elastomer 14.

As the rubber-like elastic body 11 low in compression set such as natural rubber, it means an elastomer of which compression set is 25% or less. The high damping elastomer 14 refers to a material of which tan $\delta$ is 0.15 to 1.5 at the time of 25° C., 0.5 Hz, ±50% shearing strain, and absolute value of complex modulus $|G^*|$ of 2 to 21 kgf/cm$^2$ at this time.

This absolute value of complex modulus $|G^*|$ is the absolute value of the complex modulus $G^*$, that is, $$|G^*| = \sqrt{G_1^2 + G_2^2} = G_1 \sec \delta,$$

where $G_1$ is a storage modulus, which is the quotient of the amplitude $\tau o \cdot \cos \delta$ in phase with the strain of stress divided by the strain amplitude $\gamma o$, and $G_2$ is a loss modulus, which is the quotient of the amplutude $\tau o \cdot \sin \delta$ of the component differing in phase by 90° from the strain of the stress divided by the strain amplitude $\gamma o$. Practical examples of this high damping elastomer may include butyl rubber, NBR polynorbornene etc. and also include elastomer mixtures high in damping obtained by adding reinforcing agent, filler, resins, softening agents or the like to NR, SBR, BR, polynorbornene, silicone rubber, fluororubber, chlorobutyl rubber, chloroprene rubber, urethane elastomer, or their blends.

A practical example of fabrication of the basic structure in FIG. 1 is explained below while referring to FIG. 2.

Figure 2:
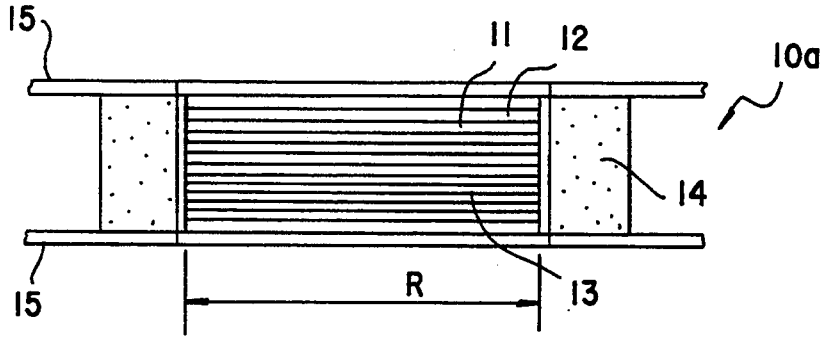
FIG. 2 is a sectional view showing a practical manufacturing example of the shakeproof bearing shown in FIG. 1.

In the shakeproof bearing 10a shown in FIG. 2, a columnar bearing body 13 is formed by using 39 pieces of natural rubber measuring 600 mm in diameter R and 4 mm in thickness as rubber-like elastic plate 11, and 38 steel plates of 2 mm in thickness as the hard plate 12 sandwiched by natural rubber. The high damping elastomer 14 disposed concentrically around this bearing body 13 is cylindrical, measuring 620 mm in inside diameter, and 880 mm in outside diameter. The high damping elastomer 14 is made of polynorbonen of which tan $\delta$ is 0.53 at the time of 25° C., 0.5 Hz, ±50% shearing strain, and absolute value of complex modulus $|G^*|$ of 7 kgf/cm$^2$ at this time. Flanges 15 of high strength are affixed to the upper and lower surfaces of the bearing body 13 and high damping elastomer 14. In this particular example, the adjoining elastic plate 11 and steel plate 12 are bonded together, although they need not be done so necessarily.

Figure 3:
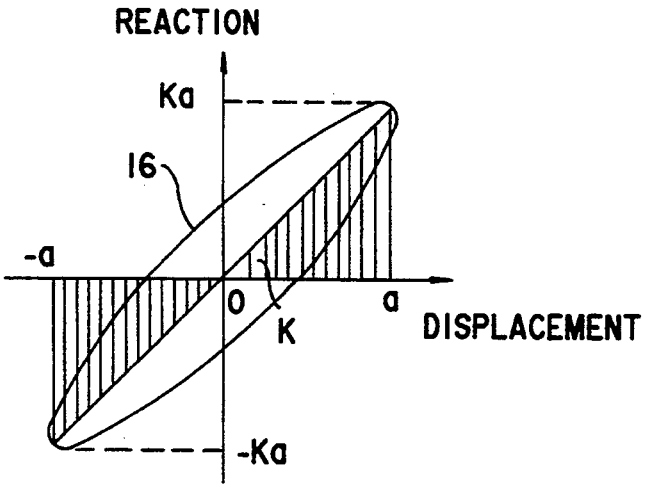
FIG. 3 is a diagram showing the hysteresis loop for exaplaining the damping constant in a high damping elastomer.

In this fabrication example, when the damping constant h in shearing deformation was measured, it was 0.12. Usually, the damping constant h of shakeproof bearing is sufficient at 0.1 to 0.15, and therefore this value of 0.12 is a sufficient value. Incidentally, the damping constant h is a value for expressing the vibration damping performance such as vibration, and it is expressed in the formula $$h = \frac{1}{2\pi} \cdot \frac{\Delta W}{W},$$

where $\Delta W$ is the energy consumed in every period of vibration, and W is the input elastic energy. When this relation is explained by the displacement in the horizontal direction and the hysteresis loop 16 plotted by its reaction in FIG. 3, $\Delta W$ is the area enclosed by the hysteresis loop 16, and W is the area of the shaded portion.

The high damping elastomer 14 of this invention may not be necessarily a single piece as shown in FIG. 1 and FIG. 2. It is enough as far as the high damping elastomer 14 is disposed around the bearing body 13 in a state capable of deforming in the horizontal direciton due to vibration during aseismic action. For example, when this high damping elastomer is made of a laminate, the damping constant may be much increased. Its practical example of fabrication is explained by referring to FIG. 4.

Figure 4:
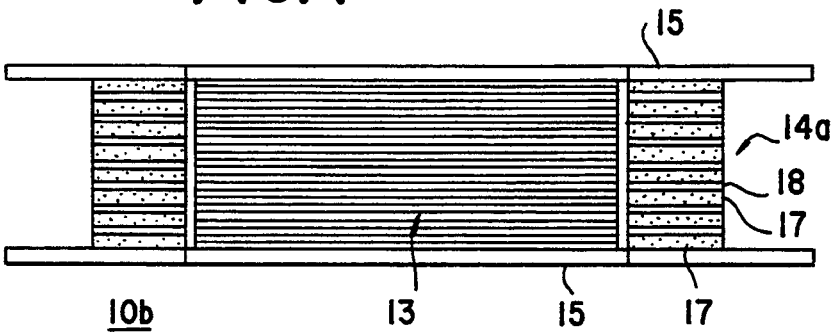
FIG. 4 is a sectional view showing a practical manufacturing example of a shakeproof bearing of the invention by using a laminated high damping elastomer.

In the shakeproof bearing 10*b* shown in FIG. 4, the portion of the high damping elastomer 14 of the shakeproof bearing 10*a* shown in FIG. 2 is laminated, while the other portions are same as the shakeproof bearing 10*a* shown in FIG. 2 in materials, dimensions, and shades. The laminate 14*a* of this high damping elastomer is composed of 20 high damping elastomer plates 17 of 7.8 mm in thickness, being laminated with 4 mm thick steel plates 18 alternately as hard plates. The overall dimensions of the laminate 14*a* are same as those of the high damping elastomer 14 shown in FIG. 2, that is, cylindrical measuring 620 mm in inside diameter and 880 mm in outside diameter. The material of the high damping elastomer plates 17 is also same as the high damping elastomer 14 shown in FIG. 2, that is, polynorbornene having tan $\delta$ of 0.53 at the time of 25° C., 0.5 Hz, ±50% shearing stress, and absolute value of complex modulus of 7 kgf/cm$^2$ at this time. As the hard plates 18, steel plates or the like may be used, but in order to enhance the fireproof performance, it is preferable to use nonflammable or flame-retardant materials low in thermal conductivity.

In this fabrication example, it is necessary to adhere the layers of the laminate 14*a* of the high damping elastomer. As previously described, the layers in the bearing body 13 are, while not necessarily, bonded together. This is because the layers are naturally adhered when subjected to a large vertical load.

When the damping constant of the shakeproof bearing 10*b* shown in FIG. 4 in shearing deformation was measured, it was 0.14. It is larger than the value of the shakeproof bearing 10*a* in FIG. 2.

Figure 5:
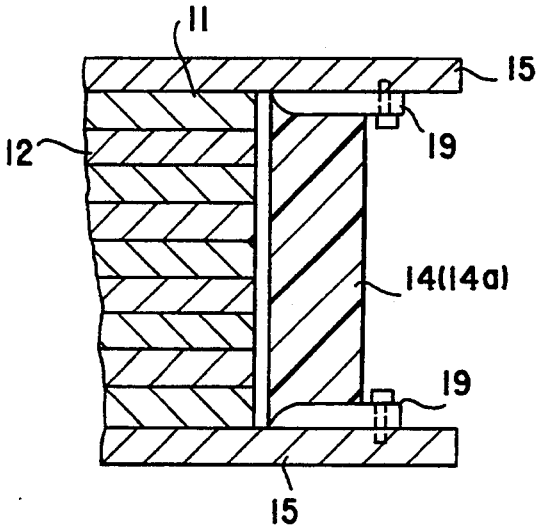
FIG. 5 is a sectional view showing a structure example for mounting the high damping elastomer.
Figure 6:
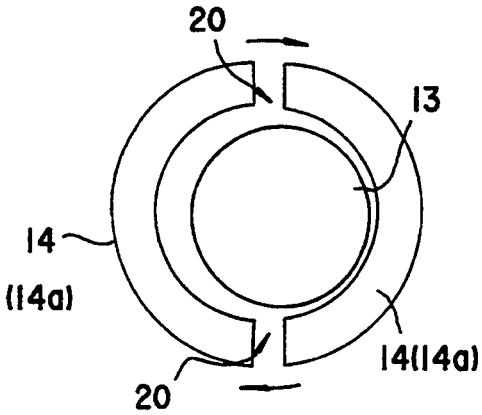
FIG. 6 is a drawing for explaining the structure for mounting the high damping elastomer on the bearing body by dividing.

Incidentally, it is desired to affix the high damping elastomer 14 or laminate 14*a* to upper and lower flanges 15 by using mounting plates 19, 19, for example, valcanized and adhered to the upper and lower surfaces thereof as shown in FIG. 5. It is because the damping action is exhibited more easily when directly exposed to the relative dislocation of the superstructure and substructure.

Meanwhile, at least one cut 20 may be provided in the high damping elastomer 14 or its laminate 14*a*. By this split structure, it is possible to install in an existing shakeproof bearing. This structure is realized because the high damping elastomer 14 or its laminate 14*a* is mounted externally, and aside from the case of internal disposition of the high damping elastomer, it is possible to install a high damping elastomer having a different outside diameter even afterwards. Therefore, the damping performance of the shakeproof bearing may be varied later. It is also easy to manufacture the laminated portion because it can be made independently of the high damping elastomer.

Figure 7:
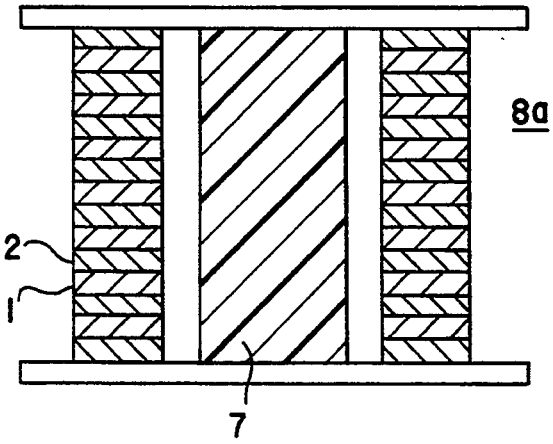
FIG. 7 is a sectional view showing a shakeproof bearing having a high damping elastomer installed internally at a clearance, as a reference example to be compared with the invention.
Figure 12:
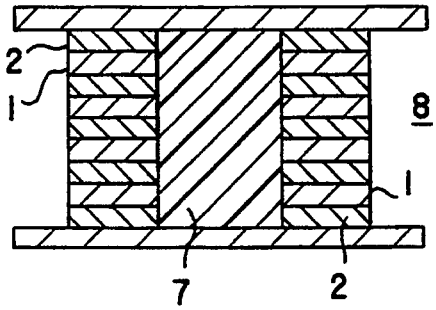
FIG.12 PRIOR ART

It is by the concept of providing the high damping elastomer with a permissible space for bulging out that the high damping elastomer 14 or its laminate 14*a* is disposed outside the bearing body 13 in this invention. This concept may be considered to be applied to the shakeproof bearing 8 shown in FIG. 12 as prior art so as to make the inside of the bearing body 8 larger than the outside diameter of the high damping elastomer 7 as shown in FIG. 7. But when the high damping elastomer 7 is installed internally as in this example the free surface of the laminated portion of the rubber-like elastic plate and hard plate is formed also at the inner side, and therefore the vertical stiffness of the bearing body 8*a* is significantly decreased. Consequently, in order to obtain a necessary vertical stiffness, the sectional area of the laminated bearing body 8*a* must be increased, and as a result the outside diameter of the shakeproof bearing becomes too large to be practical.

Besides, in the shakeproof bearing of the invention, as a result of disposition of high damping elastomer 14 or its laminate 14*a* around the bearing body 13, it is simultaneously provided with a fireproof performance, that is, the function of protecting the bearing body supporting the weight of the building at the time of outbreak of a fire from the fire. Especially, in the structure of disposing an ordinary adiabatic material around the bearing, if a fire breaks out after the adiabatic material is broken by the large shake of an earthquake, the bearing cannot be protected, and an aseismic structure trully possessing fireproof performance could not be manufactured. In the present method, to the contrary, since the high damping elastomer will not be broken if shaken heavily by an earthquake, it can fight fire after onset of an earthquake. Besides, by replacing the high damping elastomer after the fire, it is possible to re-use without giving any damage to the bearing itself.

Figure 8:
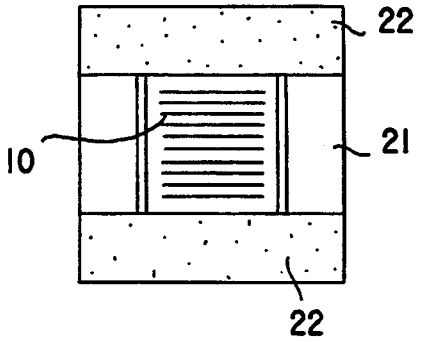
FIG. 8 is a sectional view for explaining the fire test conducted on the shakeproof bearing of the invention.
Figure 9:
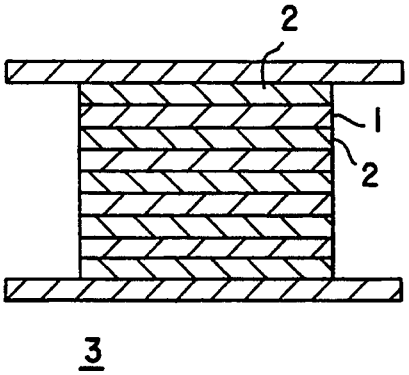
FIG.9 PRIOR ART
FIG. 9 to FIG. 12 are sectional views showing different structural examples of conventional shakeproof bearings.
Figure 10:
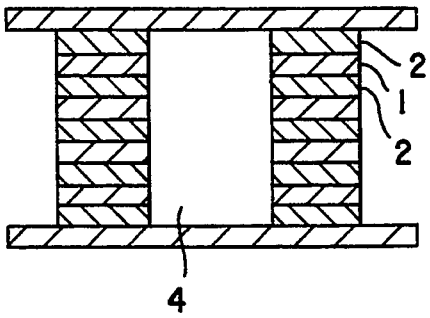
FIG.10 PRIOR ART
Figure 11:
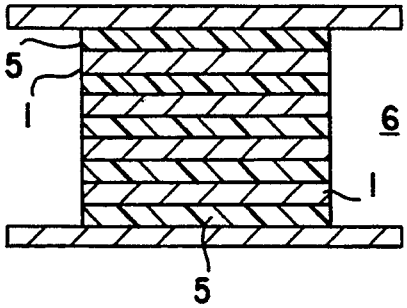
FIG.11 PRIOR ART

This fireproof performance is further explained below. For example, as shown in FIG. 8, in the fire test in which the periphery of the shakeproof bearing 10 was covered with 60 mm thick high damping elastomer 21 at a clearance of 10 mm, and fireproof coverings 22 made of ceramic fibers were disposed at the upper and lower sides, and the assembly was put into a heating oven, there was no change in the performance after withstanding for 3 hours which is required in the fireproof performance of structures. Therefore, the thickenss of the high damping elastomer to be installed should be 40 mm or more, or preferably 60 mm or more. In the high damping elastomer 14 or its laminate 14*a* shown in FIG. 2 and FIG. 4, the thickness is 130 mm, and in actual fabrication the thickness of high damping elastomer is usually considerably larger than the specified values of 40 to 60 mm, and therefore the shakeproof bearing of this invention has a sufficient fireproof performance without giving any special consideration.

In order to further enhance the fireproof performance, a flame-retardant elastomer such as silicone rubber, fluororubber and chlorobutyl may be used as the high damping elastomer, or the high damping elastomer may be blended with flame retardants of addition type such as antimony oxide, organic ester phosphate, chlorinated paraffin and inorganic salt, or flame retardants of reaction type such as tetra-bromo-bis-phenol A.

Besides, by adding a coloring matter to the high damping elastomer, the bearing simultaneously possessing fashionableness may be also realized.

According to the invention, the bearing body and damper can be assembled in a single structure, and a shakeproof bearing having a larger damping capacity can be realized at a similar creep level as the conventional laminate rubber bearing made of natural rubber.

Besides, the high damping elastomer disposed around the bearing body as a damper exhibits the fireproof function at the same time, and the shakeproof bearing of this invention is also enhanced in the reliability in this aspect.

What is claimed is:

1. A seismic shakeproof bearing having an elastomer material of which tan $\delta$ is 0.15 to 1.5 at 25° C., 0.5 Hz, 50% shearing strain and absolute value of complex modulus $|G^*|$ of 2 to 21 kgf/cm$^2$ at 25° C. and $$|G^*| = \sqrt{G_1^2 + G_2^2} = G_1 \sec \delta,$$

where $G_1$ is a storage modulus, which is the quotient of the amplitude $\tau o \cdot \cos \delta$ in phase with the strain of stress divided by the strain amplitude $\gamma o$, and $G_2$ is a loss modulus which is the quotient of the amplitude $\tau o \cdot \sin \delta$ of the component differing in phase of 90° from the strain of the stress divided by the strain amplitude $\tau o$ and disposed around, but not adhered to, a bearing body formed by alternately laminating, to each other, a hard plate possessing stiffness and a rubber-like elastic plate having a compressive set of not more than 25%.

2. A seismic shakeproof bearing having laminated hard, stiff plates and plate-shaped high damping elastomer members alternately laminated and adhered, to each other, around, but not adhered to, a bearing body formed of laminated hard, stiff plates and rubber-like elastic plates having a compression set of not more than 25% said elastomer members being of elastomer material of which tan δ is 0.15 to 1.5 at 25° C., 0.5 Hz, 50% shearing strain and absolute value of complex modulus $|G^*|$ of 2 to 21 kgf/cm$^2$ at 25° C. and $$|G^*| = \sqrt{G_1^2 + G_2^2} = G_1 \sec \delta,$$

where $G_1$ is a storage modulus, which is the quotient of the amplitude $\tau o \cdot \cos \delta$ in phase with the strain of stress divided by the strain amplitude $\gamma o$, and $G_2$ is a loss modulus which is the quotient of the amplitude $\tau o \cdot \sin \delta$ of the component differing in phase of 90° from the strain of the stress divided by the strain amplitude $\tau o$.

3. A seismic shakeproof bearing according to claims 1 or 2 wherein said high damping elastomer means being separated into at least two portions such that said high damping elastomer means forms a non-contiguous structure around said bearing body.

4. A seismic shakeproof bearing comprising:

a high damping elastomer means; and a bearing body formed by alternately laminating together, a hard plate possessing stiffness, and a rubber elastic plate having low compressive set, said high damping elastomer means disposed around but not adhered to said bearing body.

5. A seismic shakeproof bearing comprising:

a) a high damping elastomer formed of 1) hard, stiff plates, and 2) plate-shaped high damping elastomer members alternately laminated and adhered to said hard stiff plates; and b) a bearing body formed of laminated 1) hard, stiff plates, and 2) rubber elastic plates having low compression set, wherein said high damping elastomer means is disposed around said bearing body.

6. A seismic shakeproof bearing according to claims 4 or 5 wherein said high damping elastomer means being separated into at least two portions such that said high damping elastomer means forms a non-contiguous structure around said bearing body.

* * * * *